US007216612B2

(12) United States Patent
Futakuchi et al.

(10) Patent No.: US 7,216,612 B2
(45) Date of Patent: May 15, 2007

(54) INTERNAL COMBUSTION ENGINE HAVING CYLINDER FORMED WITH WATER JACKET AND VEHICLE PROVIDED WITH THE SAME

(75) Inventors: Yorio Futakuchi, Shizuoka (JP); Hideaki Kawabe, Shizuoka (JP); Akihiko Ookubo, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/197,995

(22) Filed: Aug. 5, 2005

(65) Prior Publication Data

US 2007/0028865 A1 Feb. 8, 2007

(51) Int. Cl.
*F02F 1/10* (2006.01)

(52) U.S. Cl. ..... 123/41.72

(58) Field of Classification Search ..... 123/41.72, 123/41.74, 41.84, 193.2
See application file for complete search history.

(56) References Cited

U.S. PATENT DOCUMENTS 4,294,203 A * 10/1981 Jones ..... 123/195 R
4,515,112 A * 5/1985 Tsuchiya et al. ..... 123/41.84
4,815,419 A * 3/1989 Kitada et al. ..... 123/41.42
5,261,357 A * 11/1993 Suh ..... 123/41.57
5,842,447 A * 12/1998 Krotky et al. ..... 123/41.28
6,886,505 B2 * 5/2005 Laufenberg et al. ..... 123/41.74
7,017,532 B2 * 3/2006 Ozaki et al. ..... 123/41.72

FOREIGN PATENT DOCUMENTS

JP 2002-180104 6/2002
WO WO 02/053899 7/2002
WO WO 2004/002658 1/2004

* cited by examiner

*Primary Examiner*—Stephen K. Cronin
*Assistant Examiner*—Hyder Ali
(74) *Attorney, Agent, or Firm*—Keating & Bennett, LLP

(57) ABSTRACT

An internal combustion engine includes a cylinder head, a cylinder having an opposed surface opposed to the cylinder head and including a water jacket, which is concave in an axial direction of the cylinder, and a piston provided in the cylinder. An oil ring is provided on the piston on a side that is farthest from the cylinder head. At least a portion between a cylinder inner surface and the water jacket in the cylinder is made of a material having a higher thermal conductivity than that of iron. A bottom wall of the water jacket is positioned in the cylinder axial direction between the opposed surface of the cylinder and a lower end of the oil ring when the piston is disposed at a top dead center position.

15 Claims, 10 Drawing Sheets

INTERNAL COMBUSTION ENGINE HAVING CYLINDER FORMED WITH WATER JACKET AND VEHICLE PROVIDED WITH THE SAME

BACKGROUND OF THE INVENTION

1. Field of the Invention

The present invention relates to an internal combustion engine having a cylinder formed with a water jacket and a vehicle provided with the same.

2. Description of the Related Art

In an engine in which a cylinder and a cylinder head are combined, the cylinder is exposed to high-temperature combustion gas in the same manner as the cylinder head. Conventionally, water-cooled type engines having a cylinder are frequently provided with a water jacket.

In recent years, the use of a cylinder made of aluminum alloy instead of a cylinder made of cast iron has been proposed in order to make an engine lightweight. Aluminum alloy is superior in thermal conductivity to iron. Therefore, a water jacket having the same shape and dimension as those in a conventional cylinder made of cast iron is conventionally provided in a cylinder made of aluminum alloy on the basis that sufficient cooling can be obtained with the same water jacket. See, for example, Abstract of Pamphlet of International Publication WO2002/053899.

The inventors of the present application have found that when using a material having an excellent thermal conductivity as a material for a cylinder, an overall desired performance for an internal combustion engine cannot necessarily be obtained with the same water jacket as a conventional cast iron cylinder.

SUMMARY OF THE INVENTION

In order to overcome the problems described above, preferred embodiments of the present invention provide a water jacket suited to a cylinder made of a material having an excellent thermal conductivity in order to achieve a high performance internal combustion engine.

An internal combustion engine according to a preferred embodiment of the present invention includes a cylinder head, a cylinder having an opposed surface formed with an opening and opposed to the cylinder head, a cylinder inner surface extending from a peripheral edge of the opening in a predetermined cylinder axial direction to define a combustion chamber, a concave water jacket arranged around the opening on the opposed surface substantially in the cylinder axial direction and having a bottom wall defining a concave bottom, a piston provided in the cylinder and having a piston body and a plurality of rings mounted to a periphery of the piston body to be aligned in the cylinder axial direction, the plurality of rings including a bottom ring positioned on a side that is farthest from the cylinder head and having an upper end that constitutes an end toward the cylinder head and a lower end that constitutes an end in opposition to the cylinder head, at least a portion in the cylinder between the cylinder inner surface and the water jacket made from a material having a higher thermal conductivity than that of iron, and the bottom wall of the water jacket being positioned in the cylinder axial direction between the opposed surface and the lower end of the bottom ring when the piston is disposed in a top dead center position.

An internal combustion engine according to a preferred embodiment of the present invention includes a cylinder head, a cylinder having an opposed surface formed with an opening and opposed to the cylinder head, a cylinder inner surface extending from a peripheral edge of the opening in a predetermined cylinder axial direction to define a combustion chamber, a concave water jacket arranged around the opening on the opposed surface substantially in the cylinder axial direction and having a bottom wall defining a concave bottom, a piston arranged in the cylinder so as to be able to reciprocate, a piston body and a plurality of rings mounted to a periphery of the piston body to be aligned in the cylinder axial direction, a crankshaft that rotates as the piston reciprocates, the plurality of rings including a top ring positioned on a side nearest to the cylinder head and having an upper end that constitutes an end toward the cylinder head and a lower end that constitutes an end in opposition to the cylinder head, at least a portion in the cylinder between the cylinder inner surface and the water jacket made from a material having a higher thermal conductivity than that of iron, and the bottom wall of the water jacket being positioned in the cylinder axial direction between the upper end of the top ring when a crank angle is about 0° and the upper end of the top ring when the crank angle is about 60°, where the crank angle is made about 0° when the piston is disposed in a top dead center position.

An internal combustion engine according to a preferred embodiment of the present invention includes a cylinder head, a cylinder having an opposed surface formed with an opening and opposed to the cylinder head, a cylinder inner surface extending from a peripheral edge of the opening in a predetermined cylinder axial direction to define a combustion chamber having a predetermined diameter, a concave water jacket arranged around the opening on the opposed surface substantially in the cylinder axial direction, a piston provided in the cylinder, at least a portion in the cylinder between the cylinder inner surface and the water jacket made from a material having a higher thermal conductivity than that of iron, and a depth of the water jacket from the opposed surface is at most about 0.33 times the diameter of the combustion chamber.

With the internal combustion engine, at least a portion of the cylinder between the cylinder inner surface and the water jacket is made from a material having a higher thermal conductivity than that of iron, and the water jacket is formed to be relatively shallow. Therefore, while the cylinder is effectively cooled by the cooling water in the water jacket it is also possible to prevent excessive cooling. Accordingly, it is possible to achieve improved engine performance while maintaining the cooling capacity.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1:
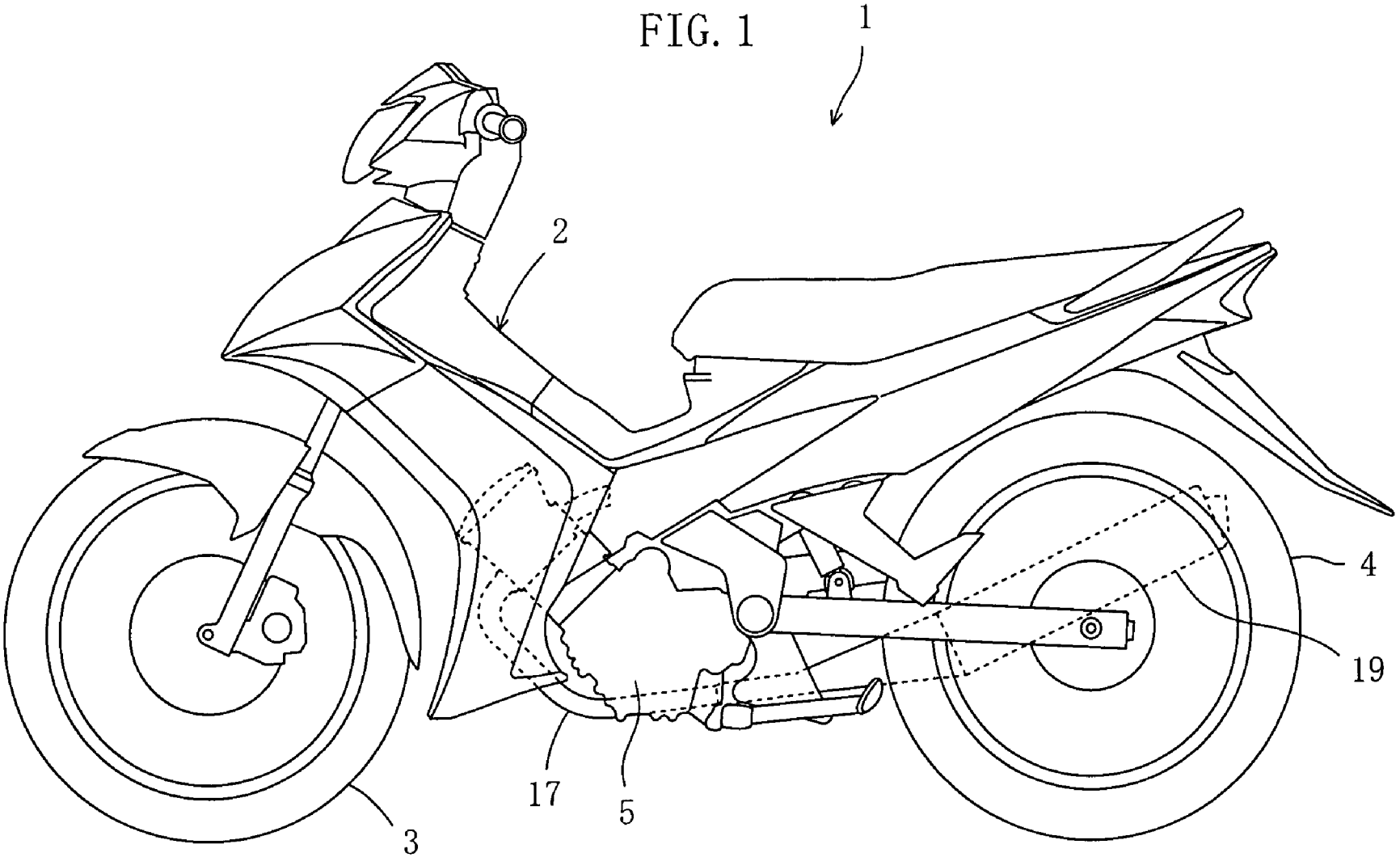
FIG. 1 is a side view showing a motorcycle.

As shown in FIG. 1, a vehicle according to a preferred embodiment includes a motorcycle 1. However, a vehicle according to preferred embodiments of the present invention is not limited to the motorcycle 1. A vehicle according to the present invention may include other saddle-ride type vehicles or vehicles other than saddle-ride type vehicles. In addition, "motorcycle" includes scooters, etc. in addition to so-called motorbikes.

The motorcycle 1 includes a vehicle body 2, a front wheel 3 and a rear wheel 4, which are mounted to the vehicle body 2, and an engine 5 that drives the rear wheel 4 through a drive chain or the like (not shown). In the present preferred embodiment, the engine 5 preferably includes a single cylinder 4-cycle internal combustion engine, for example. However, the engine 5 is in no way limited in the number of cylinders, etc.

Figure 2:
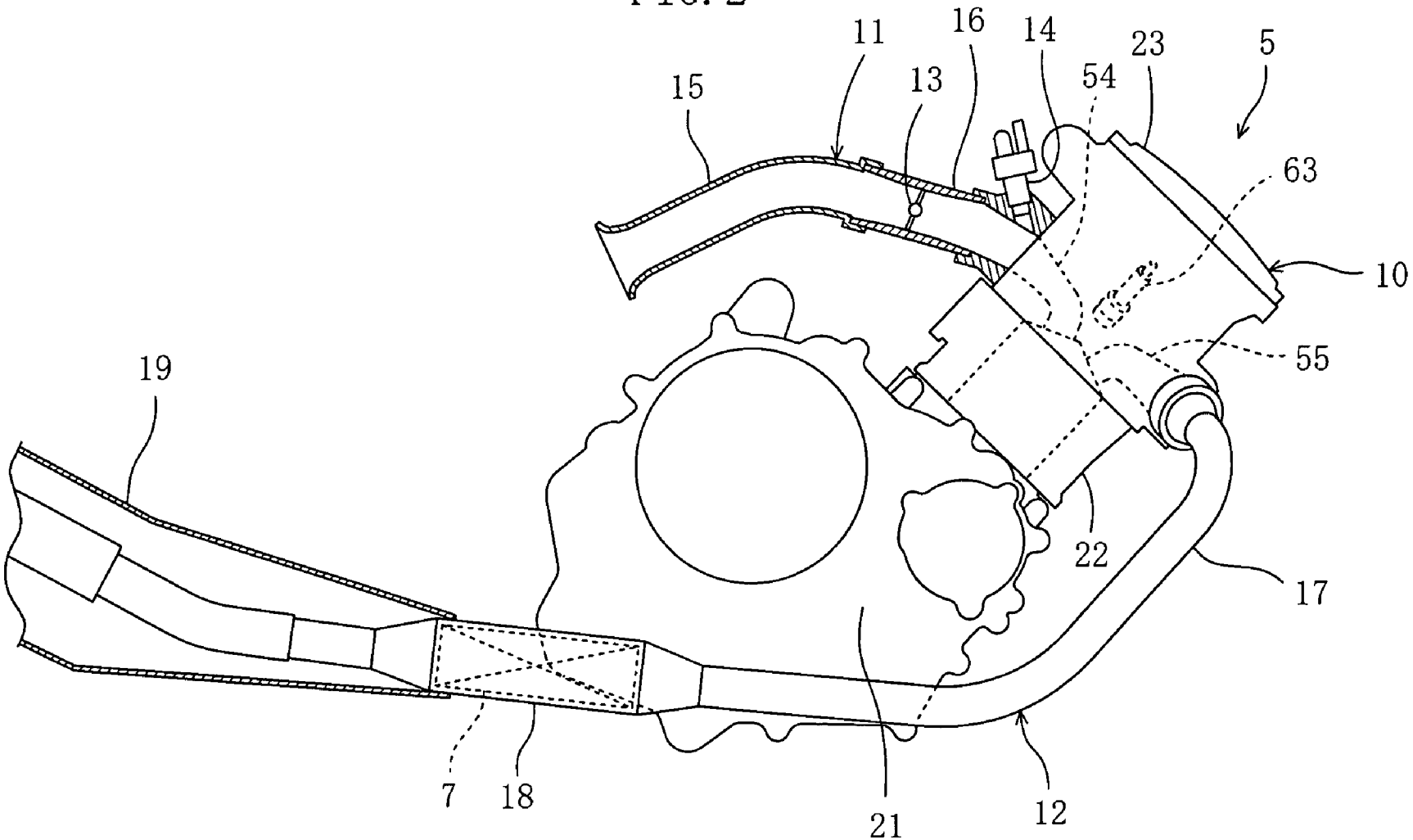
FIG. 2 is a view showing the construction of an engine.

As shown in FIG. 2, the engine 5 includes an engine body 10, an intake passage 11 , and an exhaust passage 12. The engine body 10 includes a crankcase 21, in which a crankshaft 42 or the like (see FIG. 3) is accommodated, a cylinder 22 unified with the crankcase 21, and a cylinder head 23 mounted to the cylinder 22. According to the present preferred embodiment, the crankcase 21 and the cylinder 22 are unified together to form a cylinder block. However, the crankcase 21 and the cylinder 22 may be formed separately and assembled to each other.

The intake passage 11 includes an intake pipe 15 connected to an air cleaner (not shown), a throttle body 16, and an intake port 54 formed in the cylinder head 23. A downstream end of the intake pipe 15 is connected to an upstream end of the throttle body 16, and a downstream end of the throttle body 16 is connected to the cylinder head 23. A throttle valve 13 is provided within the throttle body 16. An injector 14 is mounted to the cylinder head 23. That is, the injector 14 is arranged in the intake passage 11 downstream of the throttle valve 13. Accordingly, the injector 14 jets a fuel between the throttle valve 13 and an intake opening 52 (see FIG. 3), as described later.

The exhaust passage 12 includes an exhaust port 55 arranged on the cylinder head 23, an exhaust pipe 17 connected to the cylinder head 23, a catalyst casing 18 provided on the exhaust pipe 17, and a muffler 19 provided at a tip end of the exhaust pipe 17. A ternary catalyst 7 is accommodated within the catalyst casing 18.

Figure 3:
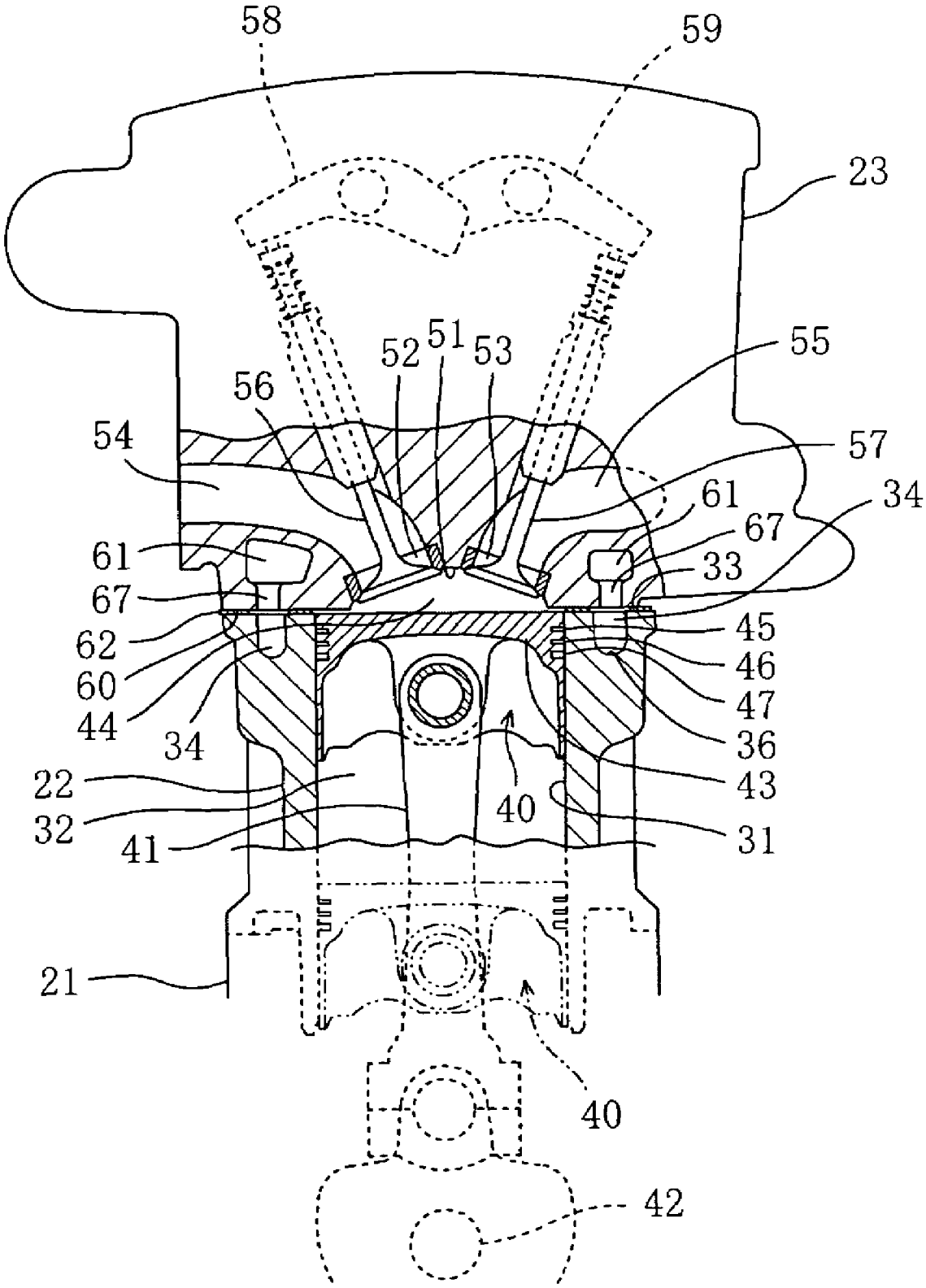
FIG. 3 is a cross sectional view showing an essential part of the engine.

As shown in FIG. 3, a cylinder inner surface 31 defines a column shaped cylinder chamber 32 inside the cylinder 22, and a piston 40 is accommodated in the cylinder chamber 32. An upper side, as shown in FIG. 3, is provided on the cylinder head 23 and a lower side, as shown in FIG. 3, is provided on the cylinder 22. However, the vertical relationship between the cylinder head 23 and the cylinder 22 is actually dependent upon a position and orientation of the engine 5 as mounted. Here, "upper side" and "lower side" as referred to do not necessarily mean an upper side and a lower side in a state in which the engine 5 is mounted.

The piston 40 includes a substantially cylindrical shaped piston body 43, a top ring 45 mounted to a side surface, that is, an outer peripheral surface of the piston body 43, a second ring 46, and an oil ring 47. The plurality of piston rings, that is, the top ring 45, the second ring 46, and the oil ring 47 are arranged in this order from above to below.

The piston body 43 is connected to an upper end of a connecting rod 41 and a lower end of the connecting rod 41 is connected to a crankshaft 42. The piston 40 reciprocates between a predetermined top dead center position (a position indicated by solid lines in FIG. 3) and a bottom dead center position (a position indicated by two-dot chain lines in FIG. 3) within the cylinder 22. As the piston 40 reciprocates, the crankshaft 42 rotates.

The cylinder 22 is preferably made from a material having a higher thermal conductivity than that of iron. Preferably, the material of the cylinder 22 has a thermal conductivity of at least about 90 W/(m·K) at, for example, about 0° C. According to the present preferred embodiment, the cylinder 22 is preferably formed from an aluminum alloy. However, the material of the cylinder 22 may be another aluminum based material or made from other materials.

As shown in FIG. 3, a water jacket 34 is formed on an upper surface of the cylinder 22, that is, a surface 33 opposed to the cylinder head 23. The water jacket 34 is formed by a concave groove that is concave in an axial direction (a vertical direction in FIG. 3), referred simply to below as "cylinder axial direction" of the cylinder 22. Also, the water jacket 34 is arranged so as to surround an entire periphery of the cylinder chamber 32 as viewed in the cylinder axial direction (see FIG. 8). The cylinder 22 includes the opposed surface 33 formed with an opening 35 (see FIG. 5) with the cylinder inner surface 31 extending from a peripheral edge of the opening 35 in the cylinder axial direction, and the water jacket 34 arranged around the opening 35 on the opposed surface 33.

In the specification of the present application, a deepest portion, that is, a lowermost wall surface of the water jacket 34, is referred to as "bottom wall" 36. The water jacket 34 will be described later in detail.

A pent roof type recess 51 is preferably formed on a lower surface 60 of the cylinder head 23 to cover an upper region of the cylinder chamber 32. However, the recess 51 is not limited in shape but may be, for example, semi-spherical or multi-spherical in shape. A combustion chamber 44 is defined by the recess 51, the cylinder inner surface 31, and an upper surface of the piston 40.

Figure 4:
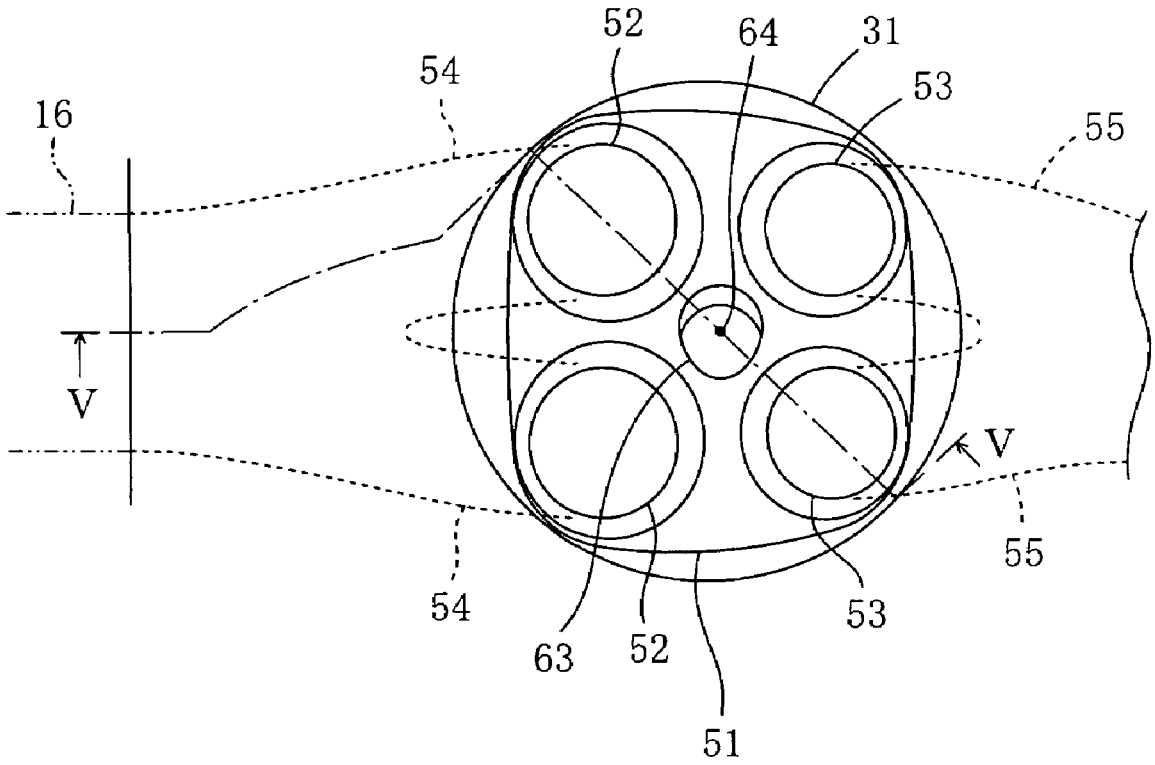
FIG. 4 is a bottom view showing a cylinder head.

As shown in FIG. 4, the recess 51 is preferably formed with two intake openings 52 and two exhaust openings 53, for example. The intake openings 52 are provided on a rear side (a left side in FIG. 4) of the vehicle body 2 to be arranged in a right and left direction (a vertical direction in FIG. 4) of the vehicle body 2. The exhaust openings 53 are provided on a front side (a right side in FIG. 4) of the vehicle body 2 to be arranged in the right and left direction of the vehicle body 2.

As shown in FIG. 3, the cylinder head 23 is formed with intake ports 54 that are in communication with the combustion chamber 44 through the respective intake openings 52, and exhaust ports 55 that are in communication with the combustion chamber 44 through the respective exhaust openings 53. As shown in FIG. 4, the intake ports 54 join together to communicate with the throttle body 16. Also, the exhaust ports 55 join together to communicate with the exhaust pipe 17 (see FIG. 2).

As shown in FIG. 3, the cylinder head 23 is provided with intake valves 56 that open and close the intake openings 52, and exhaust valves 57 that open and close the exhaust openings 53. The intake valves 56 and the exhaust valves 57, respectively, are biased in directions in which the intake openings 52 and the exhaust openings 53 are closed. Also, the cylinder head 23 is provided with rocker arms 58, 59, respectively, that periodically open and close the intake valves 56 and the exhaust valves 57. However, avalve operating mechanism that opens and closes the intake valves 56 and the exhaust valves 57 is in no way limiting.

Figure 5:
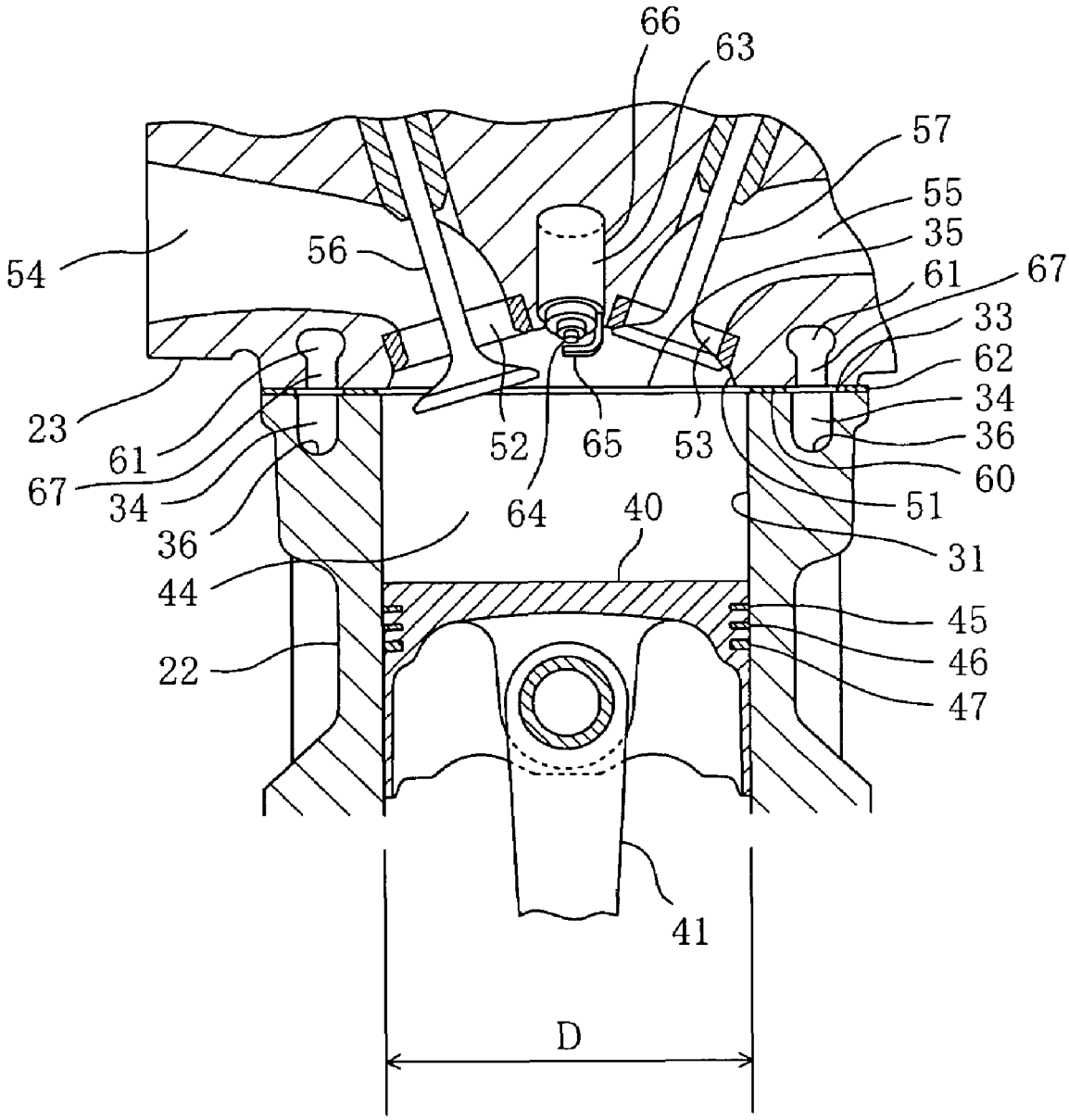
FIG. 5 is a cross sectional view taken along the line V—V in FIG. 4.

As shown in FIG. 5, the cylinder head 23 is provided with an ignition plug 63. The ignition plug 63 includes a plug body 66, a central electrode 64 provided at a tip end of the plug body 66, and a lateral electrode 65. The central electrode 64 and the lateral electrode 65 project toward the combustion chamber 44 from the recess 51 of the cylinder head 23.

An annular-shaped water jacket 61 is arranged in the cylinder head 23. The water jacket 61 is arranged in a position corresponding to the water jacket 34 in the cylinder 22 to substantially surround an entire periphery of the combustion chamber 44 as viewed in the cylinder axial direction.

Figure 7:
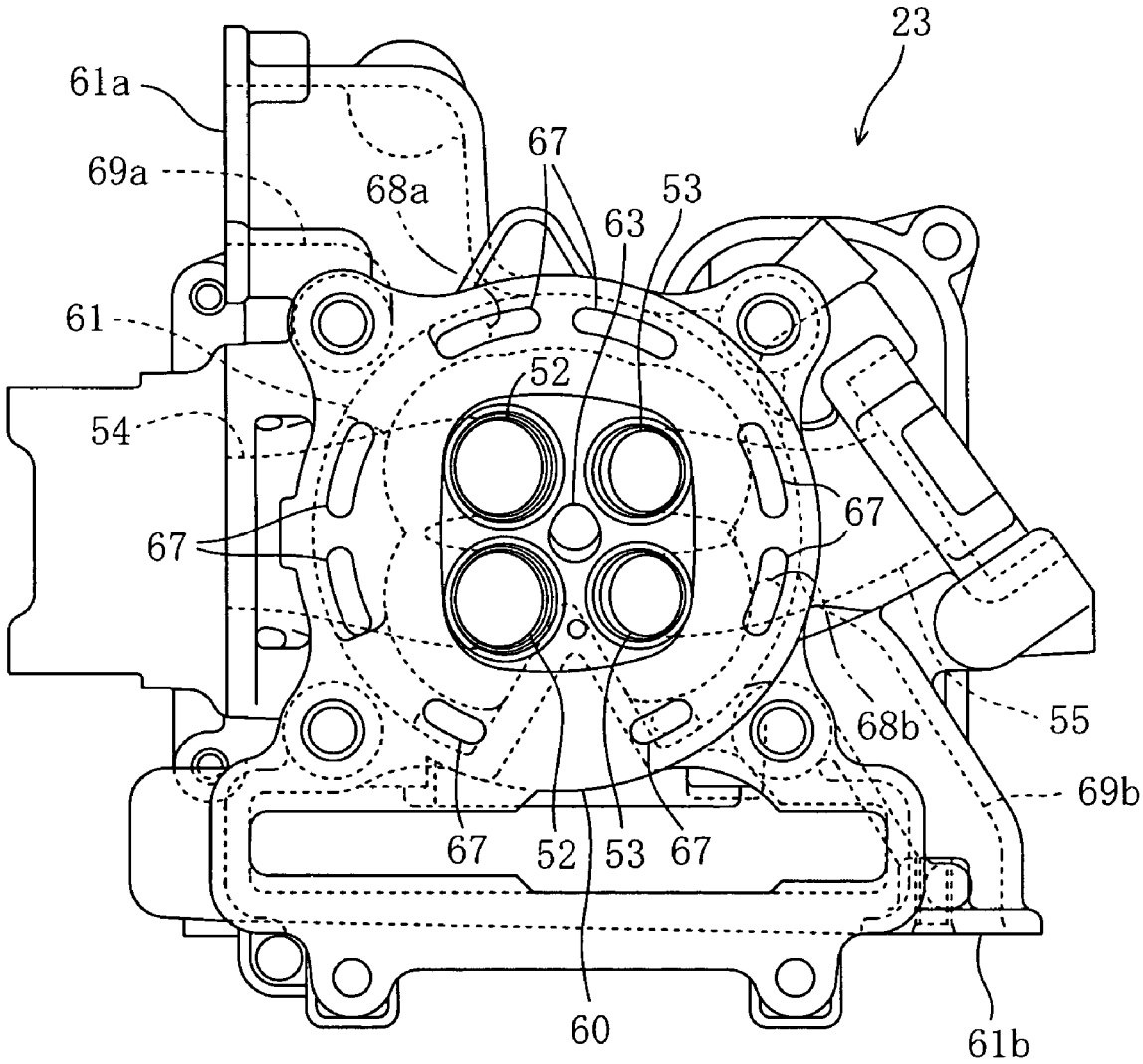
FIG. 7 is a bottom view showing a cylinder head.

As shown in FIG. 7, the lower surface 60 of the cylinder head 23 is formed with a plurality of openings 67 that are in communication with the water jacket 61. The openings 67 are also provided in positions opposed to the water jacket 34 in the cylinder 22 and arranged circumferentially at intervals to surround the periphery of the combustion chamber 44 as viewed in the cylinder axial direction.

The cylinder head 23 is also provided with an inlet port 61*b* for introduction of cooling water and an outlet port 61*a* for discharge of the cooling water. An introduction passage 69*b* is formed in the cylinder head 23 through which the cooling water introduced from the inlet port 61*b* is conducted to the water jacket 61 and a return passage 69a through which the cooling water in the water jacket 61 is conducted to the outlet port 61*a*. In addition, while an illustration is omitted, a water pump is mounted to the cylinder head 23 and the cooling water fed from the water pump is introduced into the water jacket 61 through the inlet port 61*b* and the introduction passage 69*b*.

Figure 8:
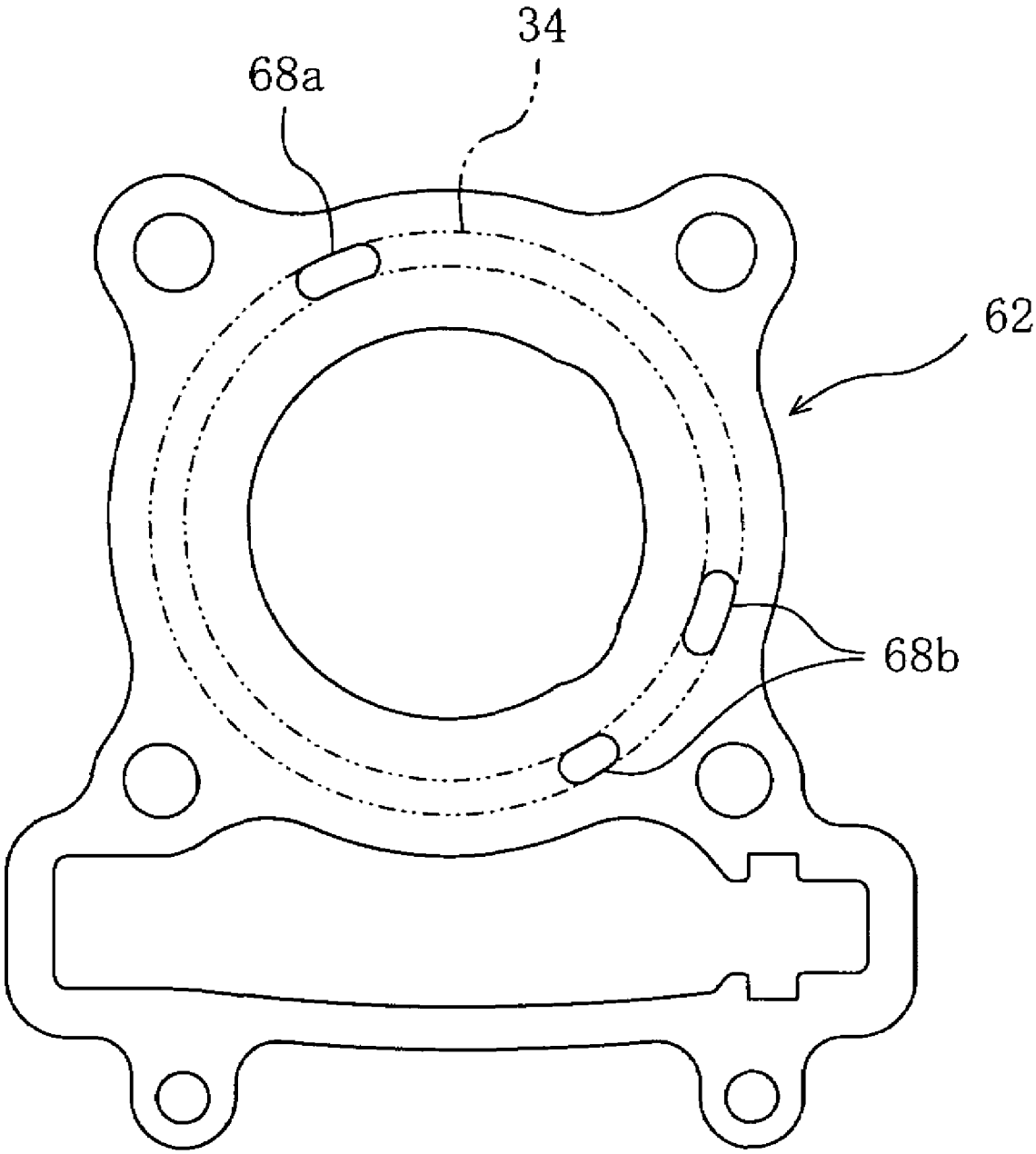
FIG. 8 is a bottom view showing a gasket.

As shown in FIG. 5, a gasket 62 is interposed between the cylinder head 23 and the cylinder 22. As shown in FIG. 8, the gasket 62 is preferably formed with two introduction communication holes 68*b* and preferably a single return communication hole 68*a*. The introduction communication holes 68*b* are provided in the vicinity of the introduction passage 69*b* (see FIG. 7) of the cylinder head 23 to overlap the openings 67 positioned in the vicinity of the introduction passage 69*b* in the cylinder axial direction (a direction perpendicular to the plane of FIG. 7). The return communication hole 68*a* is provided in the vicinity of the return passage 69*a* (see FIG. 7) of the cylinder head 23 to overlap the openings 67 positioned in the vicinity of the return passage 69*a* in the cylinder axial direction. However, the introduction communication holes 68*b* and the return communication hole 68*a* are in no way limited in position, shape, and number.

Subsequently, flow of the cooling water will be described. The cooling water having been introduced from the inlet port 61*b* of the cylinder head 23 flows into the water jacket 61 through the introduction passage 69*b*. Then some of the water in the water jacket 61 flows into the water jacket 34 in the cylinder 22 through the introduction communication holes 68*b* and the openings 67 corresponding thereto. The cooling water having flowed into the water jacket 34 flows through the water jacket 34 and then returns to the water jacket 61 of the cylinder head 23 through the return communication hole 68*a* and the opening 67 corresponding thereto. The water returned to the water jacket 61 from the water jacket 34 joins the water having flowed through the water jacket 61 in order to be discharged from the outlet port 61*a* through the return passage 69*a*. In this manner, the cooling water flows through the water jacket 61 and the water jacket 34 whereby the cylinder head 23 and the cylinder 22 are cooled.

Subsequently, the water jacket 34 of the cylinder 22 will be described in detail.

Figure 9:
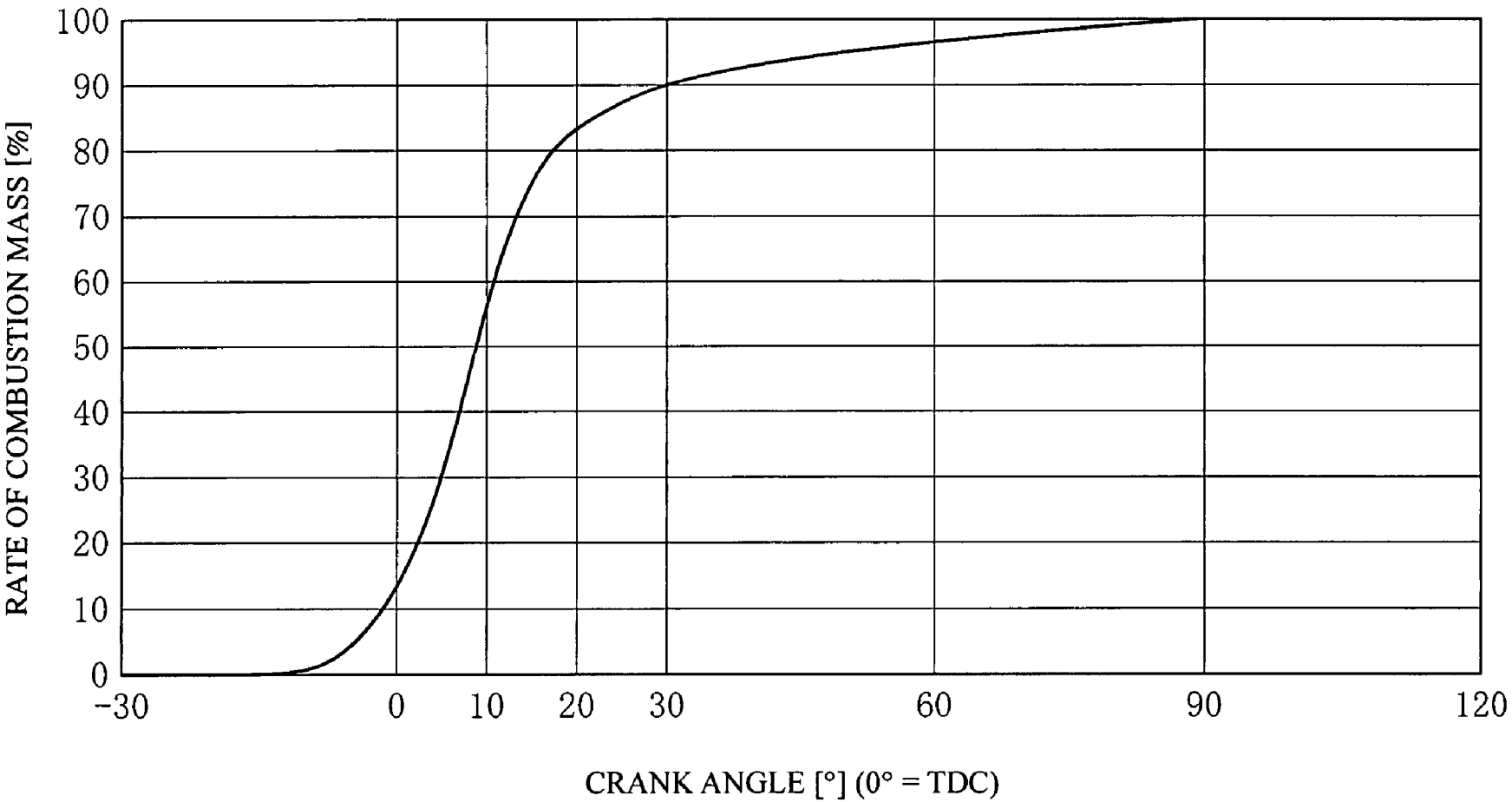
FIG. 9 is a graph illustrating the relationship between a crank angle and a rate of combustion mass.

A curve in FIG. 9 represents the relationship between a crank angle and a degree in which burning in the combustion chamber 44 proceeds. In FIG. 9, an axis of abscissas represents a crank angle with a top dead center position of compression as a reference (crank angle=0) and an axis of ordinates represents a rate of combustion mass. In addition, the curve remains substantially the same even when an engine speed is varied. Here, the engine speed is in the order of about 3,000 rpm to about 5,000 rpm.

As seen from FIG. 9, burning rapidly proceeds when the crank angle is about −10° to about 30° and the rate of combustion mass becomes about 90% when the crank angle is about 30°. When the crank angle is over about 30° burning gently proceeds, and when the crank angle is about 60° burning is substantially wholly terminated. In this manner, burning in the combustion chamber 44 is mostly generated in a stage before the crank angle becomes about 30°. Therefore, an increase in heating value is caused before the crank angle becomes about 30°, and a decrease in heating value is caused after the crank angle becomes about 30°. Also, when the crank angle is over about 60°, the heating value is substantially decreased as compared with the stage before the crank angle becomes about 30°.

Since the combustion chamber 44 is varied in volume according to a position of the piston 40, it is varied in volume according to the crank angle. Specifically, when the crank angle is about 0°, the combustion chamber 44 becomes a minimum in volume, thereafter increases in volume as the crank angle is increased, and becomes a maximum when the crank angle is about 180°. Here, combustion gas is varied in temperature as the combustion chamber 44 is varied in volume and is decreased as the combustion chamber 44 is increased in volume. Therefore, combustion gas lowers in temperature as the crank angle is increased. Accordingly, after burning is mostly terminated and combustion gas is rapidly lowered in temperature as the crank angle is increased.

As a result, the heating value of the cylinder inner surface 31 is greatly dispersed. More specifically, the upper portion of the cylinder inner surface 31 where the burning is mostly generated receives a large amount of heat, and the lower portion of the cylinder inner surface 31 where burning has been mostly terminated receives a small amount of heat.

Since conventional cylinders made of cast iron are low in thermal conductivity, the velocity at which heat is conducted in an interior of a cylinder (that is, the heat flux) is small. Therefore, a water jacket in a cylinder is formed relatively deep so as to cool the whole cylinder evenly. However, in the case where a cylinder is made of a material having a higher thermal conductivity than that of iron, the velocity at which heat is conducted in an interior of the cylinder is increased. Accordingly, the cylinder is rapidly cooled by cooling water in a water jacket, so that when the water jacket is formed too deep, there is a fear that the cylinder is cooled locally more than is needed.

When the cylinder is low in temperature, however, a lubricating oil present between a piston and the cylinder becomes low in temperature in some cases such that an increase in viscosity inhibits the lubricating property. Therefore, the friction of the piston becomes large so as to cause a fear of a decrease in output of the engine.

Figure 6:
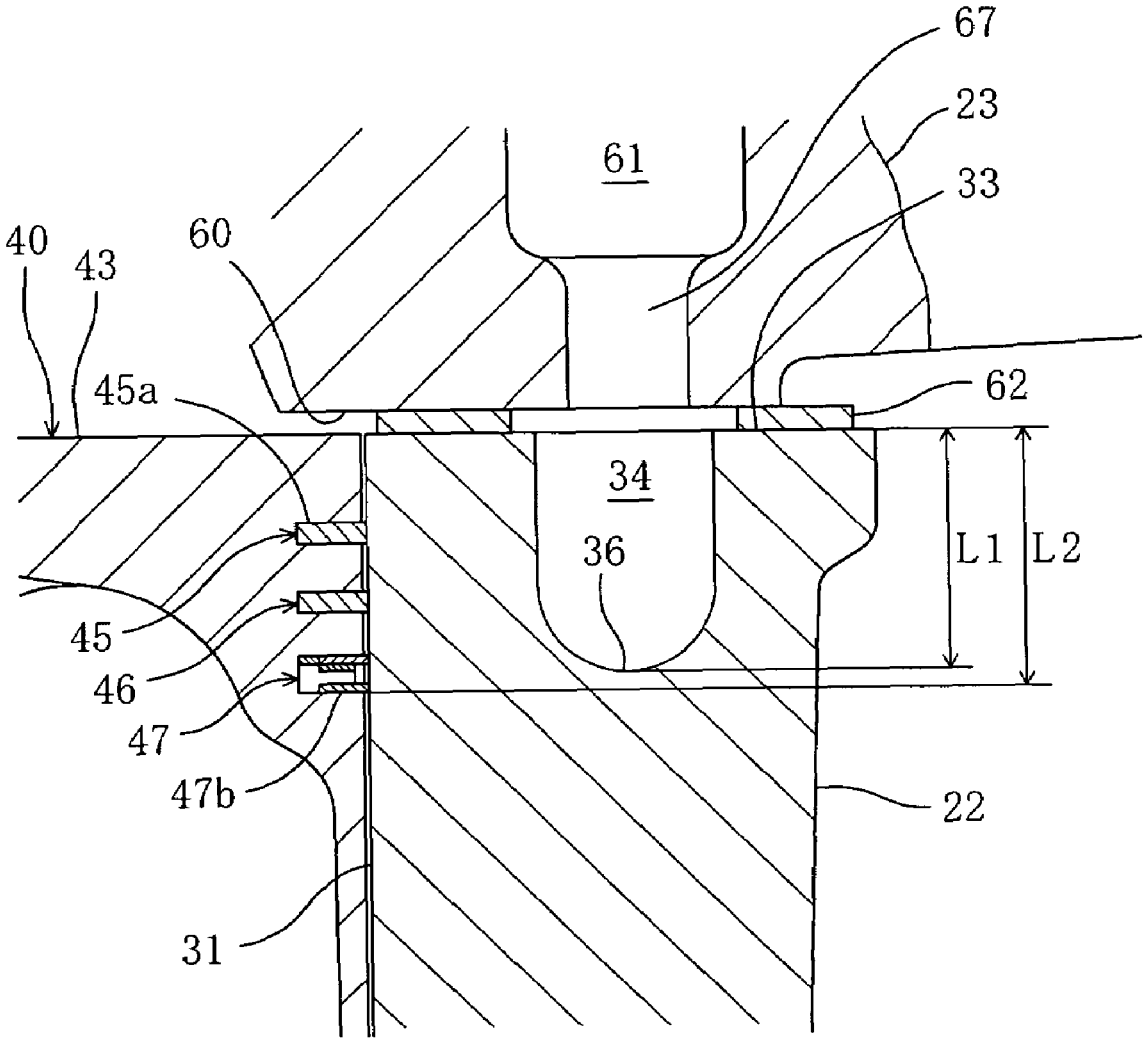
FIG. 6 is a cross sectional view showing, in enlarged scale, the area of a water jacket of a cylinder.

According to the present preferred embodiment, those portions of the cylinder 22 which need a high degree of cooling are specifically cooled while excessive cooling is avoided in those portions which need a low degree of cooling. The water jacket 34 is formed to be relatively shallow on the basis that the cylinder 22 should neither be cooled locally too much nor too little. Specifically, as shown in FIG. 6, the bottom wall 36 of the water jacket 34 is positioned above a lower end 47*b* of the oil ring 47 when the piston 40 is disposed in the top dead center position. According to the present preferred embodiment, a depth L1 of the water jacket 34 is smaller than a distance L2 between the opposed surface 33 of the cylinder 22 and the lower end 47*b* of the oil ring 47 when the piston 40 is disposed in the top dead center position.

In addition, the depth of the water jacket 34 is preferably larger than a distance between the opposed surface 33 of the cylinder 22 and an upper end 45*a* of the top ring 45 when the piston 40 is disposed in the top dead center position. That is, the bottom wall 36 of the water jacket 34 is preferably positioned between the upper end 45*a* of the top ring 45 when the piston 40 is disposed in the top dead center position and the lower end 47*b* of the oil ring 47.

According to the present preferred embodiment, the bottom wall 36 of the water jacket 34 is positioned in the cylinder axial direction, between the upper end 45*a* of the top ring 45 when the crank angle is about 0° and the upper end 45*a* of the top ring 45 when the crank angle is about 60°. The reason why the upper end 45*a* of the top ring 45 is made a reference point is that the piston body 43 and the cylinder 22 contact each other through the piston rings 45 to 47, and the upper end 45*a* of the top ring 45 is an uppermost portion among those portions (that is, the piston rings 45 to 47) through which heat is conducted to the cylinder 22 from the piston body 43.

Also according to the present preferred embodiment, a distance between the opposed surface 33 of the cylinder 22 and the upper end 45*a* of the top ring 45 when the crank angle is about 60° is about 0.33 times a cylinder bore diameter D (see FIG. 5) of the combustion chamber 44. The depth L1 of the water jacket 34 is at most about 0.33 times the diameter D of the combustion chamber 44. While the diameter D is not especially limited in value, the diameter D according to the present preferred embodiment is about 50 mm to about 60 mm.

As described above, burning in the combustion chamber 44 is mostly generated before the crank angle is about 30°. The water jacket 34 may be made more shallow in order to position the bottom wall 36 between the upper end 45*a* of the top ring 45 when the crank angle is about 0° and the upper end 45*a* of the top ring 45 when the crank angle is about 30°. Here, a distance between the opposed surface 33 of the cylinder 22 and the upper end 45*a* of the top ring 45 when the crank angle is about 30° is about 0.09 times the diameter of the combustion chamber 44. Hereupon, the depth LI of the water jacket 34 from the opposed surface 33 may preferably be made about 0.09 to about 0.33 times the diameter of the combustion chamber 44.

The water jacket 34 is recessed from the opposed surface 33 substantially in the cylinder axial direction and is not especially limited in specific shape. According to the present preferred embodiment, as shown in FIG. 6, the bottom of the water jacket 34 preferably has an arcuate-shaped cross section but the bottom may be formed to be otherwise curved or polygonal-curved, for example. The cross section of the water jacket 34 may be substantially rectangular or substantially inverse-triangular or some other suitable shape. According to the present preferred embodiment, the water jacket 34 has a substantially constant transverse width in portions other than the bottom thereof, but the transverse width of the portions may be varied in the cylinder axial direction. According to the present preferred embodiment, the water jacket 34 has a substantially constant depth in a circumferential direction but the water jacket 34 may have different depths in different places.

With the engine 5 according to the present preferred embodiment, cooling can be carried out according to the material property of the cylinder 22 and the burning property in the combustion chamber 44. That is, an upper portion of the cylinder 22 can be positively cooled by the cooling water in the water jacket 34. On the other hand, other cooling can be avoided in a lower portion of the cylinder 22. Therefore, it is possible to prevent a temperature increase in the cylinder 22 and to prevent a temperature drop in the lubricating oil in order to maintain a favorable lubricating property of the oil. Accordingly, it is possible to prevent increased friction of the piston 40 to achieve improved engine performance.

As described above, according to the present preferred embodiment, it is possible not only to simply cool the cylinder 22 but also to obtain a water jacket 34 that contributes to an improvement in the overall performance of the engine 5. Accordingly, it is possible to increase the engine performance, and hence, the motorcycle performance.

In addition, the material or construction of the cylinder 22 is not limited to those in the preferred embodiment described above but is susceptible to various modifications. The cylinder 22 may be formed from an aluminum alloy with a plating layer provided on the cylinder inner surface 31, or formed from an aluminum alloy, etc. with silicone deposited on the cylinder inner surface 31, for example.

Figure 10:
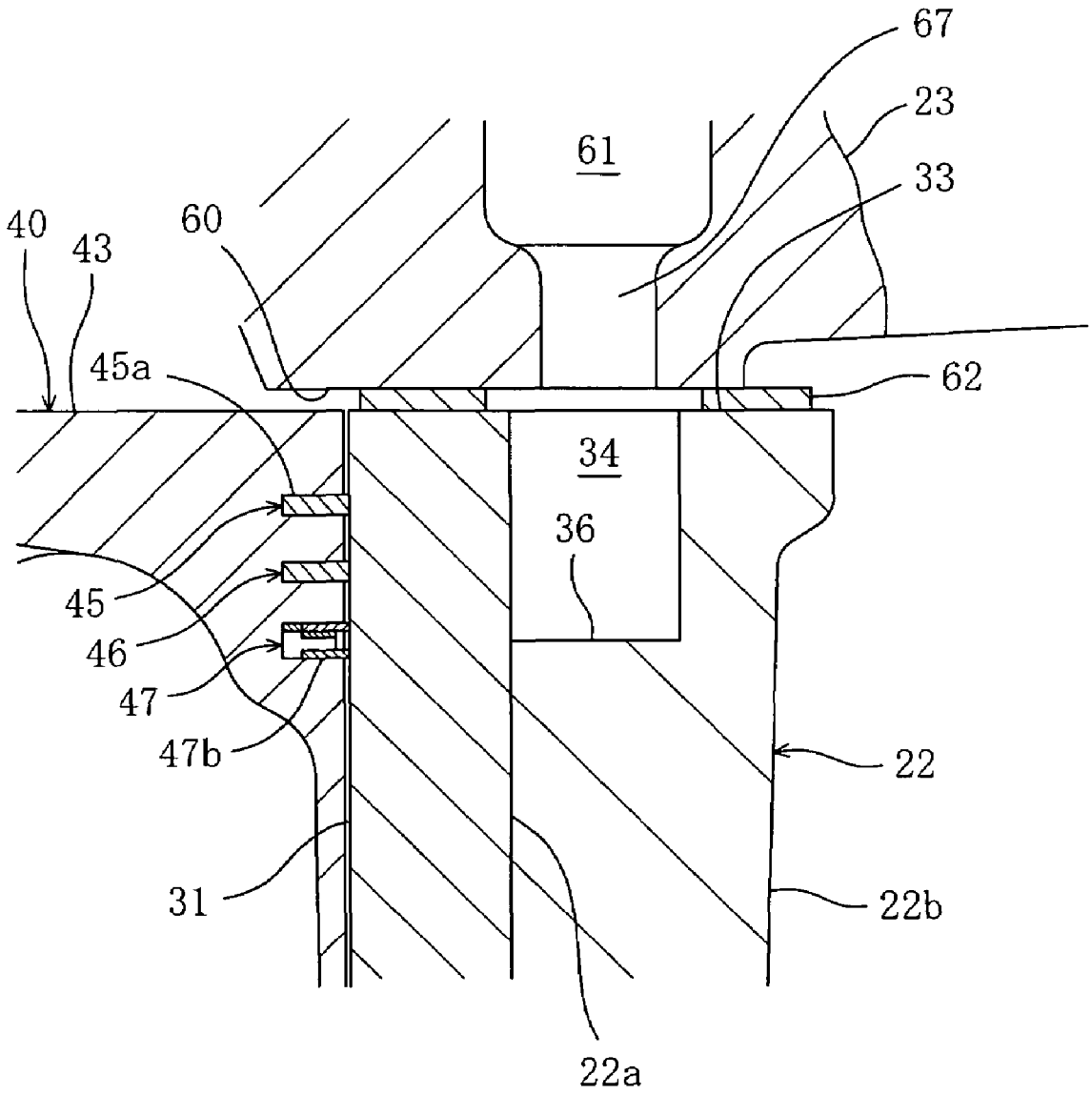
FIG. 10 is a partial cross-sectional view showing a cylinder according to a modification of preferred embodiments of the present invention.

The cylinder 22 may include a cylinder body and a sleeve fitted into the cylinder body. The water jacket 34 is not limited to a so-called dry-type construction, in which the cooling water indirectly cools the sleeve through the cylinder body, but may have a wet-type construction, in which the cooling water directly cools the sleeve. For example, as shown in FIG. 10, a cylinder 22 may include a cylinder body 22*b* and a sleeve 22*a*, and a portion of a water jacket 34 may be defined by an outer peripheral surface of the sleeve 22*a*.

In this case, it is sufficient that at least the sleeve 22*a* be formed from a material having a higher thermal conductivity than that of iron and the cylinder body 22*b* may be formed from iron, or a material having a lower thermal conductivity than that of iron. Of course, the cylinder body 22*b* may be also formed from a material having a higher thermal conductivity than that of iron. In this manner, with the engine 5 according to preferred embodiments of the present invention, it is sufficient that at least a portion in the cylinder 22 between the cylinder inner surface 31 and the water jacket 34 be formed from a material having a higher thermal conductivity than that of iron. Even in such a preferred embodiment, the same effect as that of the previous preferred embodiments can be obtained.

Also, it is sufficient that a portion in the cylinder 22 between the cylinder inner surface 31 and the water jacket 34 be higher (for example, at least about 90 W/(m·K) at about 0° C.) in thermal conductivity than iron, or the cylinder may be formed from a material which is locally different in thermal conductivity.

In addition, the manufacturing method of the cylinder 22 is in no way limited. The cylinder 22 can be manufactured by a known manufacturing method or by a method or a material disclosed in, for example, JP-A-2002-180104, Pamphlet of International Publication WO2002/053899, or Pamphlet of International Publication WO2004/002658. Contents of these documents are incorporated by reference herein.

In the present preferred embodiments, the piston rings are preferably three in number, for example, but the piston rings are in no way limited in number.

The present invention is not limited to the preferred embodiments described above, but various variations and modifications may be made without departing from the scope of the present invention. The presently disclosed preferred embodiments are therefore considered in all respects to be illustrative and not restrictive. The scope of the present invention is indicated by the appended claims rather than the foregoing description, and all changes which come within the meaning and range of equivalence thereof are intended to be embraced therein.

What is claimed is:

1. An internal combustion engine comprising:

a cylinder head;

a cylinder having an opposed surface including an opening and opposed to the cylinder head;

a cylinder inner surface extending from a peripheral edge of the opening in a predetermined cylinder axial direction to define a combustion chamber;

a water jacket arranged around the opening on the opposed surface substantially in the cylinder axial direction and including a bottom wall defining a concave bottom; and a piston provided in the cylinder, the piston including a piston body and a plurality of rings mounted to a periphery of the piston body to be aligned in the cylinder axial direction; wherein the plurality of rings include a bottom ring positioned on a side farthest from the cylinder head and having an upper end that constitutes an end toward the cylinder head and a lower end that constitutes an end in opposition to the cylinder head;

at least a portion in the cylinder between the cylinder inner surface and the water jacket is made of a material having a higher thermal conductivity than that of iron; and the bottom wall of the water jacket is positioned in the cylinder axial direction between the opposed surface and the lower end of the bottom ring when the piston is disposed in a top dead center position.

2. The internal combustion engine according to claim 1, wherein the plurality of rings include a top ring positioned on a side nearest to the cylinder head and having an upper end that constitutes an end toward the cylinder head and a lower end that constitutes an end in opposition to the cylinder head, and the bottom wall of the water jacket is positioned in the cylinder axial direction between the upper end of the top ring when the piston is disposed in the top dead center position and the lower end of the bottom ring.

3. The internal combustion engine according to claim 1, wherein at least a portion in the cylinder between the cylinder inner surface and the water jacket is made from a material having a thermal conductivity of at least about 90 W/(m·K).

4. The internal combustion engine according to claim 1, wherein at least a portion in the cylinder between the cylinder inner surface and the water jacket is made from an aluminum alloy.

5. An internal combustion engine comprising:

a cylinder head;

a cylinder having an opposed surface including an opening and opposed to the cylinder head;

a cylinder inner surface extending from a peripheral edge of the opening in a predetermined cylinder axial direction to define a combustion chamber;

a water jacket arranged around the opening on the opposed surface substantially in the cylinder axial direction and having a bottom wall defining a concave bottom;

a piston arranged in the cylinder so as to be able to reciprocate, the piston including a piston body and a plurality of rings mounted to a periphery of the piston body to be aligned in the cylinder axial direction; and a crankshaft that rotates as the piston reciprocates; wherein the plurality of rings include a top ring positioned on a side nearest to the cylinder head and having an upper end that constitutes an end toward the cylinder head and a lower end that constitutes an end in opposition to the cylinder head;

at least a portion in the cylinder between the cylinder inner surface and the water jacket made from a material having a higher thermal conductivity than that of iron; and the bottom wall of the water jacket is positioned in the cylinder axial direction between the upper end of the top ring when a crank angle is about 0° and the upper end of the top ring when the crank angle is about 60°, where the crank angle is about 0° when the piston is disposed in a top dead center position.

6. The internal combustion engine according to claim 5, wherein the bottom wall of the water jacket is positioned in the cylinder axial direction between the upper end of the top ring when the crank angle is about 30° and the upper end of the top ring when the crank angle is about 60°.

7. The internal combustion engine according to claim 5, wherein at least a portion in the cylinder between the cylinder inner surface and the water jacket is made from a material having a thermal conductivity of at least about 90 W/(m·K).

8. The internal combustion engine according to claim 5, wherein at least a portion in the cylinder between the cylinder inner surface and the water jacket is made from an aluminum alloy.

9. An internal combustion engine comprising:

a cylinder head:

a cylinder having an opposed surface including an opening and opposed to the cylinder head;

a cylinder inner surface extending from a peripheral edge of the opening in a predetermined cylinder axial direction to define a combustion chamber having a predetermined diameter; and a water jacket arranged around the opening on the opposed surface substantially in the cylinder axial direction;

a piston provided in the cylinder; wherein at least a portion in the cylinder between the cylinder inner surface and the water jacket is made from a material having a higher thermal conductivity than that of iron; and a depth of the water jacket from the opposed surface is at most about 0.33 times the diameter of the combustion chamber.

10. The internal combustion engine according to claim 9, wherein a depth of the water jacket from the opposed surface is at most about 0.09 to about 0.33 times the diameter of the combustion chamber.

11. The internal combustion engine according to claim 9, wherein at least a portion in the cylinder between the cylinder inner surface and the water jacket is made from a material having a thermal conductivity of at least about 90 W/(m·K).

12. The internal combustion engine according to claim 9, wherein at least a portion in the cylinder between the cylinder inner surface and the water jacket is made from an aluminum alloy.

13. A vehicle comprising:

a vehicle body;

a wheel mounted to the vehicle body; and an internal combustion engine that drives the wheel, wherein the internal combustion engine includes:

a cylinder head;

a cylinder having an opposed surface including an opening and opposed to the cylinder head;

a cylinder inner surface extending from a peripheral edge of the opening in a predetermined cylinder axial direction to define a combustion chamber;

a water jacket arranged around the opening on the opposed surface substantially in the cylinder axial direction and having a bottom wall defining a concave bottom;

a piston provided in the cylinder and including a piston body and a plurality of rings mounted to a periphery of the piston body to be aligned in the cylinder axial direction; wherein the plurality of rings include a bottom ring positioned on a side that is farthest from the cylinder head and having an upper end that constitutes an end toward the cylinder head and a lower end that constitutes an end in opposition to the cylinder head;

at least a portion in the cylinder between the cylinder inner surface and the water jacket is made from a material having a higher thermal conductivity than that of iron; and the bottom wall of the water jacket is positioned in the cylinder axial direction between the opposed surface and the lower end of the bottom ring when the piston is disposed in a top dead center position.

14. A vehicle comprising:

a vehicle body;

a wheel mounted to the vehicle body; and an internal combustion engine that drives the wheel, wherein the internal combustion engine includes:

a cylinder head;

a cylinder having an opposed surface including an opening and opposed to the cylinder head;

a cylinder inner surface extending from a peripheral edge of the opening in a predetermined cylinder axial direction to define a combustion chamber;

a water jacket arranged around the opening on the opposed surface substantially in the cylinder axial direction and having a bottom wall defining a concave bottom;

a piston arranged in the cylinder to be able to reciprocate, the piston including a piston body and a plurality of rings mounted to a periphery of the piston body to be aligned in the cylinder axial direction; and a crankshaft that rotates as the piston reciprocates; wherein the plurality of rings include a top ring positioned on a side nearest to the cylinder head and having an upper end that constitutes an end toward the cylinder head and a lower end that constitutes an end in opposition to the cylinder head;

at least a portion in the cylinder between the cylinder inner surface and the water jacket made from a material having a higher thermal conductivity than that of iron;

the bottom wall of the water jacket is positioned in the cylinder axial direction between the upper end of the top ring when a crank angle is about 0° and the upper end of the top ring when the crank angle is about 60°, where the crank angle is made about 0° when the piston is disposed in a top dead center position.

15. A vehicle comprising:

a vehicle body;

a wheel mounted to the vehicle body; and an internal combustion engine that drives the wheel, wherein the internal combustion engine includes:

a cylinder head;

a cylinder having an opposed surface including an opening and opposed to the cylinder head, a cylinder inner surface extending from a peripheral edge of the opening in a predetermined cylinder axial direction to define a combustion chamber having a predetermined diameter;

a water jacket arranged around the opening on the opposed surface substantially in the cylinder axial direction; and a piston provided in the cylinder; wherein at least a portion in the cylinder between the cylinder inner surface and the water jacket is made from a material having a higher thermal conductivity than that of iron; and a depth of the water jacket from the opposed surface is at most about 0.33 times the diameter of the combustion chamber.

* * * * *